US005740888A

United States Patent [19]

Aulanko et al.

[11] Patent Number: 5,740,888

[45] Date of Patent: Apr. 21, 1998

[54] ARRANGEMENT IN AN OPENING IN THE WALL OF AN ELEVATOR SHAFT AND INSTRUMENT PANEL

[75] Inventors: Esko Aulanko, Kerava; Harri Hakala; Jorma Mustalahti, both of Hyvinkää, all of Finland

[73] Assignee: Kone Corporation, Hyvinkaa, Finland

[21] Appl. No.: 806,152

[22] Filed: Feb. 25, 1997

Related U.S. Application Data

[63] Continuation of Ser. No. 434,585, May 4, 1995, abandoned.

[30] Foreign Application Priority Data

May 4, 1994 [FI] Finland ..... 942063

[51] Int. Cl.[6] ..... B66B 7/12

[52] U.S. Cl. ..... 187/336; 187/414

[58] Field of Search ..... 187/250, 254, 187/314, 336, 340, 414, 313, 316, 325; 52/30

[56] References Cited

U.S. PATENT DOCUMENTS

| | | | |
|---|---|---|---|
| 5,034,056 | 7/1991 | von Bonin | 106/18.12 |
| 5,293,962 | 3/1994 | Pelvilain | 52/30 X |
| 5,377,784 | 1/1995 | Walkowiak et al. | 187/336 |

FOREIGN PATENT DOCUMENTS

| | | | |
|---|---|---|---|
| 932977 | 5/1994 | Finland . | |
| 3803317 | 8/1988 | Germany | 187/336 |
| 62-60353 | 12/1987 | Japan . | |
| 2127387 | 5/1990 | Japan | 187/336 |
| 3018569 | 1/1991 | Japan . | |
| 5-78074 | 3/1993 | Japan | 187/336 |
| 332698 | 4/1971 | Sweden . | |
| 1654214 | 6/1991 | U.S.S.R. . | |

OTHER PUBLICATIONS

Dodge, Richard W., "Vertical Transportation" Westinghouse Engineer, Mar. 1950, pp. 98–104.

*Primary Examiner*—F. J. Bartuska

*Attorney, Agent, or Firm*—Birch, Stewart, Kolasch & Birch, LLP

[57] ABSTRACT

The instrument panel (1) of an elevator is placed in the same opening (2) in the wall of the elevator shaft (17) as the landing door (3) of the elevator. The instrument panel (1) contains elevator control equipment and the electric drive controlling the hoisting motor of the elevator. The instrument panel (1) of the elevator is in connection with the jamb structure (4) of the landing door (3).

13 Claims, 2 Drawing Sheets

ARRANGEMENT IN AN OPENING IN THE WALL OF AN ELEVATOR SHAFT AND INSTRUMENT PANEL

This application is a continuation of application Ser. No. 08/434,585 filed on May 4, 1995, now abandoned.

FIELD OF THE INVENTION

The present invention relates to an arrangement in an opening in the wall of an elevator shaft and to an instrument panel.

DESCRIPTION OF THE BACKGROUND ART

One objective in the development of elevators has been efficient and economic utilization of building space. In the case of conventional traction-sheave driven elevators, the elevator machine room or other space designed for the installation of the drive machinery takes up a significant portion of the building space needed for the elevator. To save space in the building, elevator machinery solutions employing a flat construction in the direction of the shaft of the traction sheave of the elevator have been proposed lately. Because of the flat construction of the elevator machinery, the hoisting machinery can easily be installed in the elevator shaft. Finnish patent application number 932977 describes an elevator machinery of this type. Placing the instrument panel containing the elevator control system and the power electronics driving the hoisting machinery in the elevator shaft is technically possible, but in respect of maintenance and installation it would be advantageous if the instrument panel were more readily accessible than it is when placed in the elevator shaft. Similarly, the possibility to carry out minor operations on the machinery without entering the elevator shaft would be an advantage.

Swedish Publication SE B 332698 discloses an arrangement in which certain hydraulic elevator control circuits are placed at the landing beside a turn door type landing door. The construction is such that the turn door cannot be replaced with the automatic door, because in that construction the automatic landing door has no room for its opening movement.

SUMMARY OF THE INVENTION

To provide a solution to the need described above, an arrangement in an opening in the wall of an elevator shaft and a new type of instrument panel for an elevator are presented as an invention. The arrangement of the invention is characterized by an arrangement in an opening for an automatic elevator landing door in a wall of an elevator shaft. The elevator has a landing door in an opening for the elevator which is positioned in a plane when in a closed position. The arrangement comprises an instrument panel for the elevator. The instrument panel contains elevator control equipment and a drive for controlling a hoisting motor of the elevator. The instrument panel is placed in the opening with the landing door of the elevator and is spaced from the plane in which the landing door is positioned when the landing door is in the closed position. The elevator is therefore on one side of the plane while the instrument panel is on an opposite side of the plane. The instrument panel is rigidly mounted in the arrangement so as to be fixed in position relative to wall of the elevator shaft.

The advantages achieved by the invention include the following:

- The working space to be provided in front of the instrument panel as required e.g. by elevator regulations or equivalent can be easily achieved.

- The use of the relatively slim control panel does not cause bigger changes to the structural or functional features of the standard automatic landing door.
- An arrangement for visual observation of the hoisting machinery through the instrument panel is simple to realize.
- The instrument panel of the invention is especially applicable in rope-driven elevators using a hoisting machinery placed in the elevator shaft.
- The instrument panel can be provided with a hatch or equivalent through which it is possible, if permitted by the rest of the elevator lay-out, to carry out ordinary checks and operations on the machinery, such as checking/adjustment of the brake, manual release of the brake, checking the ropes and the traction sheave, possible manual operation of the elevator, etc.
- The landing on which the instrument panel is installed does not significantly differ from other landings in respect of appearance.
- The invention makes it unnecessary to provide a space for a machine room in the building.
- The solution of the invention does not require any extra apertures in the shaft wall as the instrument panel can be placed in the same opening with the landing door.
- The placement of the instrument panel in the door jamb structure is particularly advantageous in respect of electrification of the elevator.
- Being provided with a lock, the instrument panel is safe.
- The instrument panel can be provided with a space for documents pertaining to the elevator, e.g. drawings and a maintenance record.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of some of its embodiments by referring to the attached drawings which are given by way of illustration only, and thus are not limitative of the present invention, and in which.

DETAILED DESCRIPTION OF THE PREFERRED EMBODIMENTS

Figure 1:
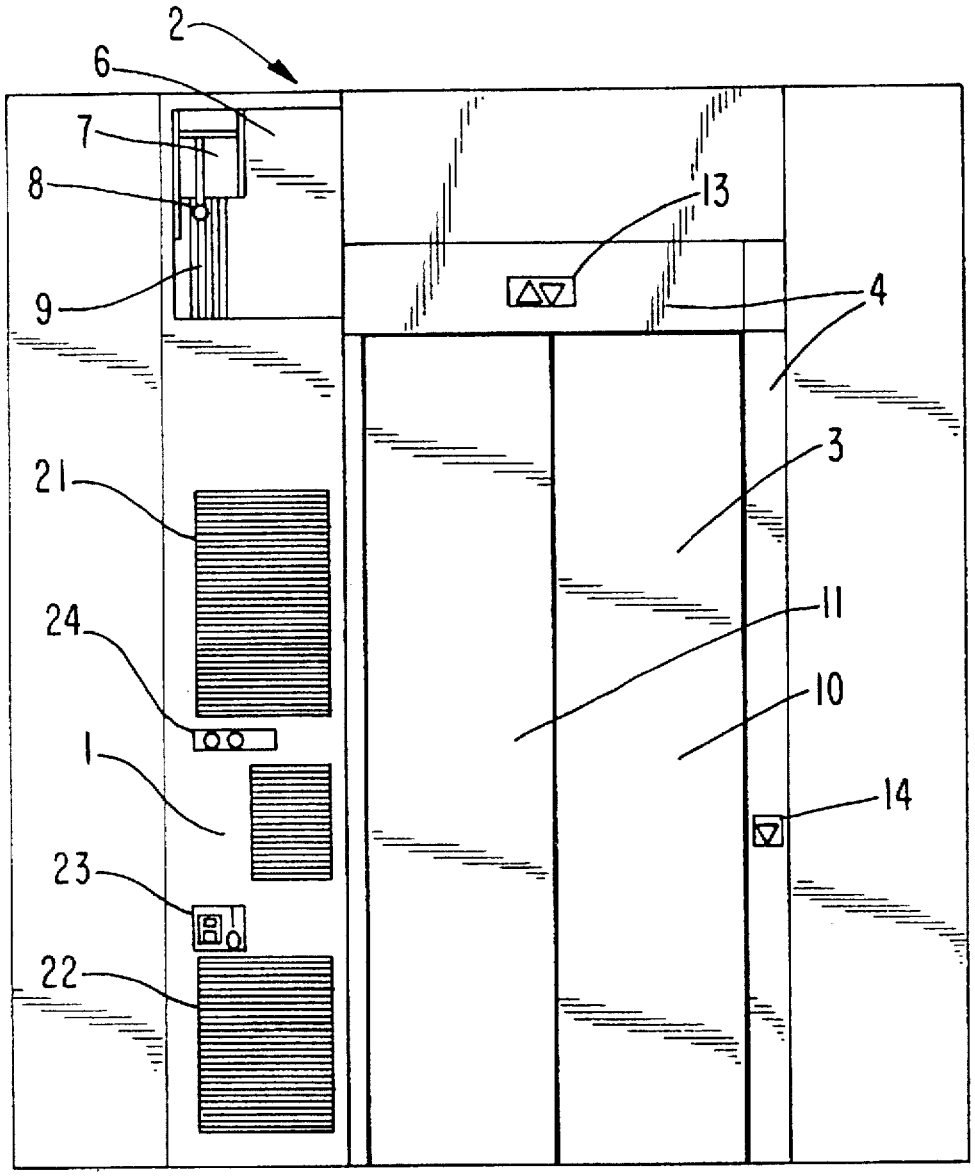
FIG. 1 presents an arrangement according to the invention as seen from the landing.
Figure 2:
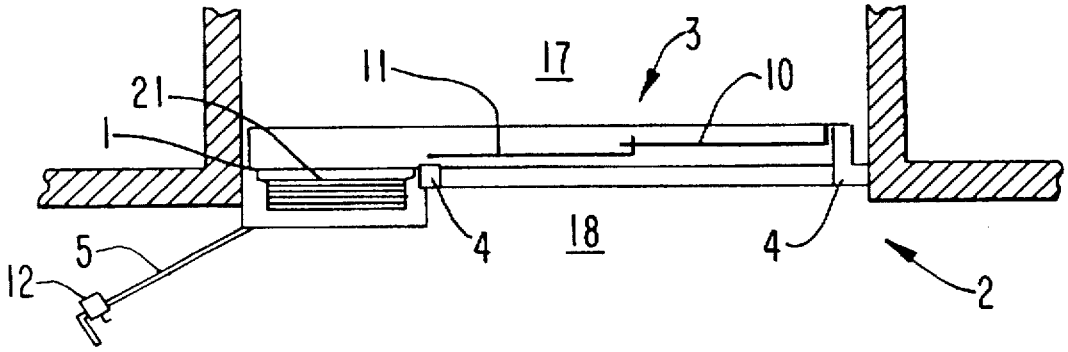
FIG. 2 presents a diagrammatic section of the lay-out of the door and instrument panel in an opening between a landing and the elevator shaft.

FIG. 1 presents an arrangement according to the invention as seen from the landing and with the cover 5 of the instrument panel 1 removed, and FIG. 2 presents a diagrammatic section of the lay-out of the door 3 and instrument panel 1 in an opening 2 between a landing 18 and the elevator shaft 17. The instrument panel 1 is an assembly containing at least the electric drive controlling the hoisting motor as well as elevator control equipment. The instrument panel 1 is placed in the same opening 2 between the landing and the elevator shaft as the door and is incorporated in the jamb structure 4 surrounding the door, being connected to the jamb structural 4 with a contact achieved e.g. by attaching the instrument panel 1 to the door jamb structure 4 or via common parts shared by the instrument panel 1 and the door jamb structure 4. In this context, the door jamb structure 4 is understood to be an assembly which, in addition to the visible parts surrounding the door 3 and the structures needed to retain these parts in place, may comprise the door frame and other conventional door supporting structures in the opening 2 or in its immediate vicinity. In front of the instrument panel 1 there is a sufficient working space on the landing e.g. for a serviceman servicing the elevator. From the instrument panel 1, the serviceman can also see the hoisting machinery through a window 6. The window may be an open aperture or a non-openable window provided with a glass pane or a net, or it may also be implemented as an openable hatch, in which case it may be either transparent or non-transparent. Through an open aperture or openable hatch it is possible to access e.g. the machinery 7 in the elevator shaft, the brake, manual brake release lever 8, ropes 9 and the traction sheave of the machinery. The window 6 may be part of the instrument panel 1, in which case looking through the window means looking through the instrument panel, or the window may be placed in some other suitable location, e.g. in the door jamb structure 4 above the door. As to its appearance, the landing on which the instrument panel is installed is like the other landings. The cover 5 may protrude from the opening 2 somewhat more than the door jamb sheets in the corresponding area on the other floors. This is because the instrument panel 1 cannot be sunk very deep into the jamb structure as there must be enough space behind the instrument panel 1 to permit movement of the door leaves 10, 11. In fact, the placement of the instrument panel could well be described by saying that the instrument panel is placed inside the jamb structure, under a cover 5 comprised in the jamb structure. Thus, no separate machine room is needed in the building as the hoisting machinery 7 is placed in the elevator shaft and the instrument panel 1 in the door jamb structure. The cover 5 may be removable or it may be so hinged that it can be turned aside off the instrument panel 1 like the cover in FIG. 2. The cover may have a construction consisting of one or more parts, and it is preferably provided with a lock 12 to allow it to be locked in place. The cables to be connected to the instrument panel 1 can easily be laid in the elevator shaft 17. These cables include the conductors supplying electricity to the instrument panel and from the instrument panel to the electromotor driving the machinery, as well as the wiring between the elevator control system and the signal devices 13 and call buttons 14. The elevator controller 21, electric drive 22, main switch 23, emergency operating buttons 24 and other devices in the instrument panel 1 are accessible when the cover 5 is open.

Figure 3:
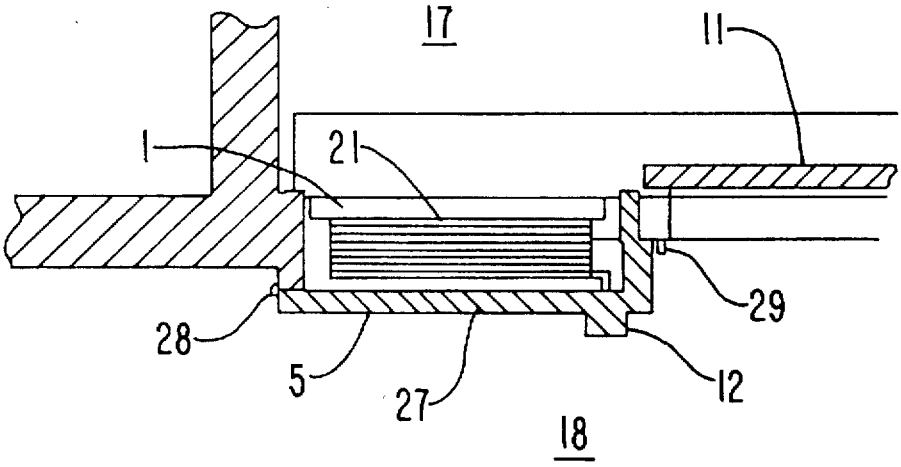
FIG. 3 presents a more detailed view of a door jamb structure containing an instrument panel.

FIG. 3 presents a more detailed view of a door jamb structure containing an instrument panel. The jamb structure is lined with a fireproof material 27, preferably e.g. mineral wool sheets, which, in addition to being fireproof, has a noise insulating capability. The lining of the jamb structure is so designed with respect to fire resistance and noise insulation that it corresponds at least to the fire resistance and noise insulating capability of landing doors. The cover is suspended on the jamb structure by means of a hinge 28. On the side facing towards the landing 18, the space between the jamb structure and the cover 5 is protected with a body 29 attached to the jamb structure and covering the gap between the jamb structure and the cover. As the fire cell division achieved through the placement of the fireproof material follows the landing-side wall of the jamb structure and of the cover of the instrument panel placed in it, the instrument panel need not be insulated from the shaft space 17 and ventilation of the instrument panel via the shaft space is simple to achieve. The fire cell division can also be implemented in another way, e.g. by placing the fireproof lining on the shaft-side wall of the jamb structure containing the instrument panel.

It is obvious to a person skilled in the art that different embodiments of the invention are not restricted to the examples described above, but that they may instead be varied within the scope of the following claims.

It is obvious to the person skilled in the art that the applicability of the invention is not restricted to elevators of the type presented in Finnish patent application no. 932977, but that the invention can be applied to other basic elevator solutions, e.g. elevators in which the drive machinery is placed in the counterweight.

It is further obvious to the skilled person that "instrument panel" may refer to an instrument cabinet mounted on the door jamb structure and containing the electric drive controlling the hoisting motor of the elevator and the elevator control equipment, or e.g. an assembly comprising two instrument cabinets mounted in the door jamb structure and containing the electric drive in one cabinet and the elevator control equipment in the other.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An arrangement in an opening for an automatic elevator landing door in a wall of an elevator shaft, the landing door being in an opening for the elevator and being positioned in a plane when in a closed position, the arrangement comprising an instrument panel for the elevator, the instrument panel containing elevator control equipment, an access opening with a window and a drive for controlling a hoisting motor of the elevator, the instrument panel being placed in the opening with the landing door of the elevator and being spaced from the plane in which the landing door is positioned when the landing door is in the closed position such that the elevator is on one side of the plane and the instrument panel is on an opposite side of the plane, the instrument panel being rigidly mounted in the arrangement so as to be fixed in position relative to the wall of the elevator shaft and the instrument panel and window preventing ready access to the elevator shaft.

2. The arrangement for an elevator according to claim 1, wherein the landing door is movable in the plane from the closed position to an open position and wherein the landing door is between the elevator and the instrument panel when the landing door is in the open position.

3. The arrangement for an elevator according to claim 1, wherein the elevator shaft is visible through the window, the access opening being spaced from the elevator control equipment in the instrument panel.

4. The arrangement for an elevator according to claim 3, wherein the window is positioned in an upper part of the instrument panel.

5. The arrangement for an elevator according to claim 1, further comprising an openable cover for the instrument panel.

6. The arrangement for an elevator according to claim 5, further comprising a lock provided on the cover, the cover being movable between an open position providing access to at least the instrument panel and a closed position covering the at least the instrument panel, the lock latching the door in the closed position.

7. The arrangement for an elevator according to claim 5, wherein the cover is movable between an open position providing access to at least the instrument panel and a closed position covering the at least the instrument panel and the window.

8. The arrangement for an elevator according to claim 1, wherein the landing door has a door jamb structure and wherein at least the instrument panel is integrated as a part of the door jamb structure.

9. The arrangement for an elevator according to claim 1, further comprising fireproofing in the instrument panel.

10. The arrangement for an elevator according to claim 9, wherein the fireproofing comprises a mineral wool sheet lining placed on a jamb structure wall facing towards a landing for the elevator.

11. The arrangement for an elevator according to claim 1, further comprising noise insulating means provided in the instrument panel for isolating a landing of the elevator from the shaft.

12. The arrangement for an elevator according to claim 11, wherein the noise insulating means comprises a mineral wool sheet lining placed on a jamb structure wall facing towards the landing for the elevator.

13. The arrangement for an elevator according to claim 1, wherein the instrument panel is in front of the elevator when the elevator is adjacent the landing door.

* * * * *